US005397250A

United States Patent [19]

Briones

[11] Patent Number: 5,397,250

[45] Date of Patent: Mar. 14, 1995

[54] MODULAR JACK WITH FILTER

[75] Inventor: Francisco R. Briones, Markham, Canada

[73] Assignee: Amphenol Corporation, Wallingford, Conn.

[21] Appl. No.: 43,544

[22] Filed: Apr. 6, 1993

[51] Int. Cl.[6] ..... H01R 13/66

[52] U.S. Cl. ..... 439/620; 439/607

[58] Field of Search ..... 439/620, 676, 607, 79

[56] References Cited

U.S. PATENT DOCUMENTS

| | | | |
|---|---|---|---|
| 4,210,376 | 7/1980 | Hughes et al. | 439/676 |
| 4,327,958 | 5/1982 | Hughes et al. | 339/276 |
| 4,500,159 | 2/1985 | Briones et al. | 339/147 R |
| 4,618,207 | 10/1986 | Silbernagel | 339/176 |
| 4,629,266 | 12/1986 | Viselli | 339/17 |
| 4,695,115 | 9/1987 | Talend | 439/76 |
| 4,703,991 | 11/1987 | Philippson | 439/676 |
| 4,726,638 | 2/1988 | Farrar et al. | 439/620 R |
| 4,772,224 | 9/1988 | Talend | 439/607 |
| 4,850,902 | 7/1989 | Reed | 439/676 |
| 4,884,982 | 12/1989 | Fleming et al. | 439/620 |
| 4,950,185 | 8/1990 | Boutros | 439/620 |
| 4,992,055 | 2/1991 | Brummans et al. | 439/78 |
| 4,995,819 | 2/1991 | Ohl | 439/79 |
| 5,015,204 | 5/1991 | Sakamoto et al. | 439/620 |
| 5,083,945 | 1/1992 | Miskin et al. | 439/607 |
| 5,087,210 | 2/1992 | Myers et al. | 439/425 |
| 5,088,939 | 2/1992 | Shepherd | 439/620 |
| 5,091,826 | 2/1992 | Arnett et al. | 361/408 |
| 5,133,678 | 7/1992 | Okamoto et al. | 439/607 |
| 5,139,442 | 8/1992 | Sakamoto et al. | 439/620 |
| 5,147,224 | 9/1992 | Tan et al. | 439/620 |
| 5,178,563 | 1/1993 | Reed | 439/676 |
| 5,207,597 | 5/1993 | Kline et al. | 439/607 |

FOREIGN PATENT DOCUMENTS

| | | |
|---|---|---|
| 2-267879 | 11/1990 | Japan . |
| 2169156 | 7/1986 | United Kingdom . |

*Primary Examiner*—Eugene F. Desmond
*Attorney, Agent, or Firm*—Bacon & Thomas

[57] ABSTRACT

A modular jack connector is arranged to optionally accommodate both a ferrite block inductor arrangement and chip capacitors. The connector can be assembled and all components secured in place in four insertion steps, without any requirement for soldering or other bonding techniques.

15 Claims, 6 Drawing Sheets

MODULAR JACK WITH FILTER

BACKGROUND OF THE INVENTION

1. Field of the Invention

This invention relates to electrical connectors, and in particular to a modular jack.

2. Description of Related Art

Electrical connectors known as modular phone receptacles or jacks have been known for many years. Although connectors of this type were originally designed for use in telephone systems, they have found wide acceptance in a variety of other contexts. For example, modular jacks are now commonly used as input/output (I/O) interface connectors for enabling computers to communicate with each other and with a variety of peripheral equipment.

In order to receive a modular plug, the conventional modular jack is generally made up of a socket housing which includes a plug-receiving opening, opposed top and bottom surfaces joined by opposed side surfaces extending from the opening to a back surface, and a plurality of stamped, metallic elongated contacts mounted in the housing for engaging contacts of the corresponding plug. Each contact in this type of connector includes a contact mating portion at one end extending diagonally into the socket, a vertically extending lead portion at the other end, and a horizontally extending intermediate portion between the contact mating portion and the lead portion.

Because the above-described type of modular jack is often used for digital communications, the devices in which this type of connector is used have a tendency to emit high frequency radiation which can interfere with other electrical equipment. In addition, the devices are themselves vulnerable to noise or transients induced in an incoming line by external sources. While on-board filtering can often be used to solve such problems, the difficulty of designing circuitry which meets current emissions requirements as well as space considerations suggest that inclusion of filtering or transient suppression capabilities in the connector would be desirable under certain circumstances, and in particular where the cost of providing on-board filtering exceeds the cost of adding filters to the connector.

Nevertheless, while filtering has been used in a wide variety of different types of connectors, only a few attempts have been made to include such filters in modular jack connectors. These include the arrangement described in U.S. Pat. No. 4,726,638, which essentially provides a circuit board extending from the rear of the connector on which electrical components can be placed, and the arrangement described in U.S. Pat. No. 4,695,115 to Talend in which tombstone-style chip capacitors are soldered to the jack contacts and extend from the top of the connector to a shield placed over the contacts. These prior jack connectors have a number of disadvantages, including the fact that the filtering or transient suppression components extend too far outside the standard jack profile. In particular, considering that labor and assembly costs are often a high percentage of the cost of this type of connector, the above-described prior filtered jack connectors are disadvantageous in that they are difficult to assemble and cannot easily be customized to accommodate different filtering parameters in order to meet different customer requirements.

SUMMARY OF THE INVENTION

It is accordingly an objective of the invention to provide a modular jack connector which includes filtering or transient suppression components, and yet which does not require complicated assembly techniques such as soldering.

It is a further objective of the invention to provide a method of assembling a modular jack connector which includes filter and/or transient suppression components, and in which the difficulty of assembling the connector is minimized.

It is yet another objective of the invention to provide a modular jack connector which includes filtering and/or transient suppression capabilities and which fits substantially within the standard modular jack profile.

These and other objectives are achieved by a modular jack connector formed of a one-piece molded plastic body including an opening formed therein to receive a modular plug, opposed top and bottom surfaces joined by opposed side surfaces extending from the opening to a back surface, in which the body includes a plurality of guide slots for defining the position of a plurality of contacts, the guide slots including sets of passages capable of receiving one or two electrical component assemblies and a plurality of additional individual electrical components, thus providing maximum design flexibility.

In a further advantageous embodiment of the invention, the electrical component assemblies are monolithic ferrite inductor blocks and the individual components are chip capacitors, thereby forming LC filters for selected contacts, the contacts being modified to accommodate the chip capacitors substantially within the standard profile of a modular jack.

In a still further advantageous embodiment of the invention, the contacts and a shield may be assembled to the connector by integral latching projections provided on the molded socket so that the total number of parts required for the connector includes a single molded socket, a single shield, one or two ferrite inductor blocks, and as many contacts and chip capacitors as required for the application in which the connector is used.

Finally, a preferred method of assembling a filtered connector involves just four simple steps, including the steps of optionally inserting ferrite blocks into passageways in a molded body, inserting contacts into openings in the ferrite blocks until the contacts snap into guide grooves provided in the molded body, optionally inserting chip capacitors into the passageways after the contacts have been inserted, and fitting a shield over the socket to complete assembly. Thus, the preferred assembly method requires only at most four insertion steps to complete a filter connector having a variety of filtering options, including both C and LC filters, without having to change the arrangement or manufacture of either the shield or the main body of the connector, and in which all of the components are removable for repair or replacement.

According to yet another advantageous feature of the invention, spark gap may be provided in the housing in addition to the filter options, without requiring any additional assembly steps.

DETAILED DESCRIPTION OF THE PREFERRED EMBODIMENTS

Figure 1:
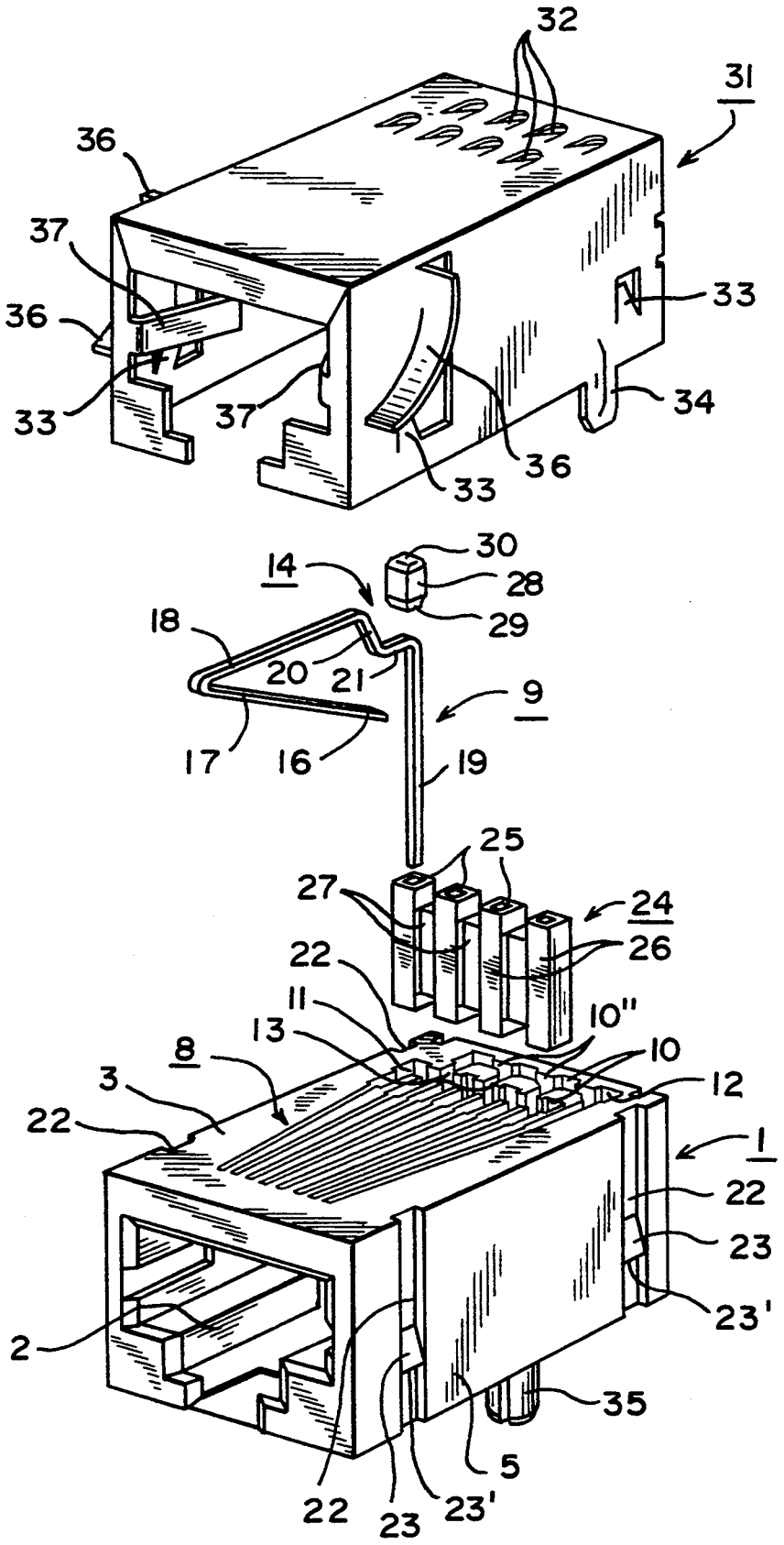
FIG. 1 is a perspective view showing the modular jack of a preferred embodiment prior to assembly.
Figure 2:
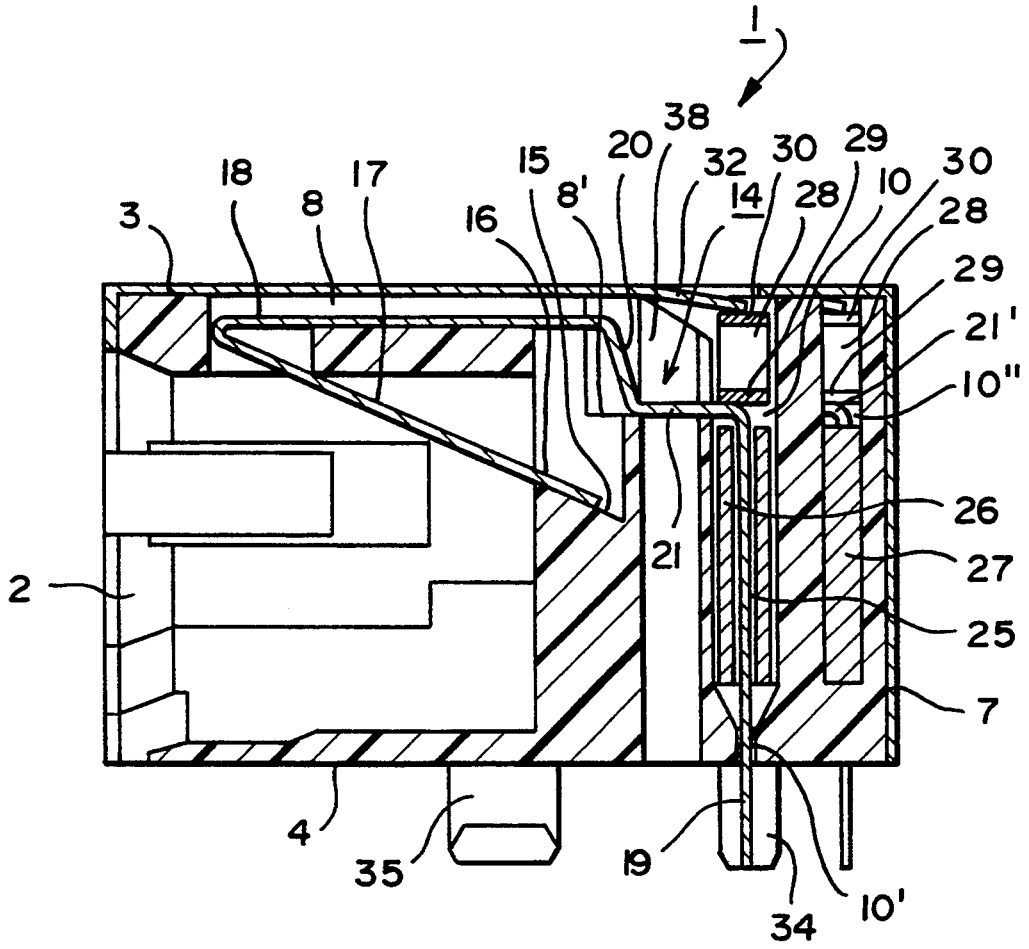
FIG. 2 is a cross-sectional side view of the assembled modular jack of FIG. 1.
Figure 4:
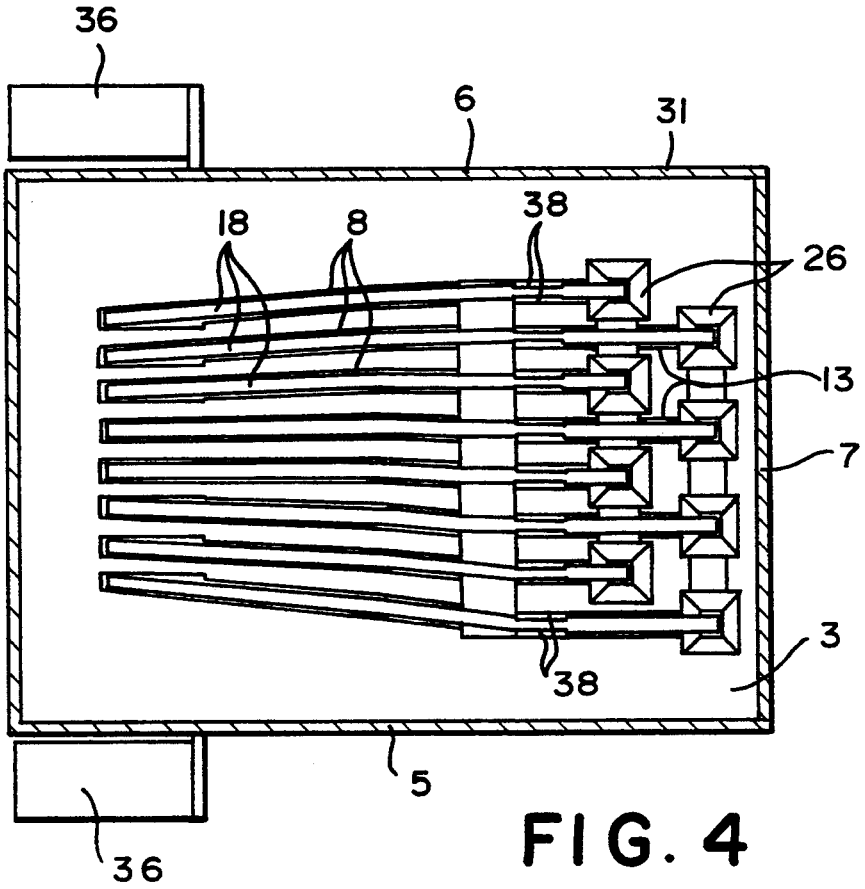
FIG. 4 is a cross-sectional top view of modular jack of FIG. 1.
Figure 3:
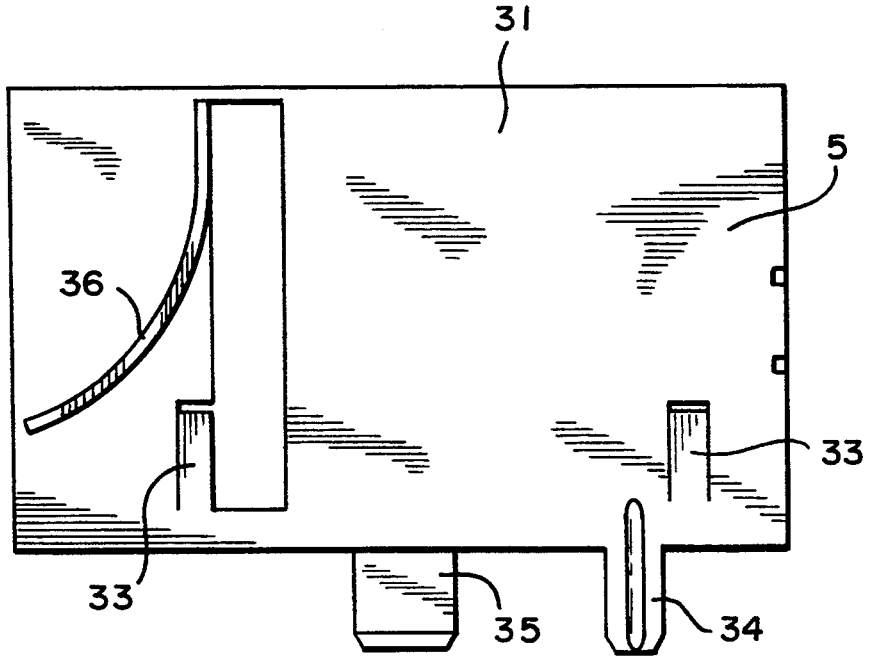
FIG. 3 is a side elevation of the modular jack of FIG. 1.
Figure 6:
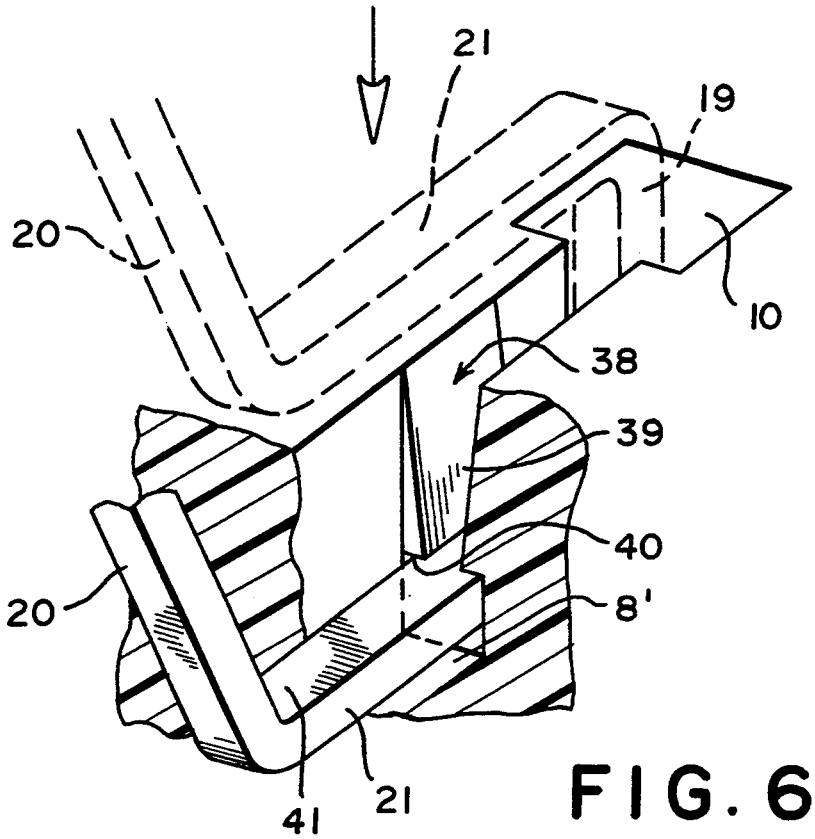
FIG. 6 is a cross-sectional perspective view of a contact locking device for use in the modular jack of FIG. 1.
Figure 5:
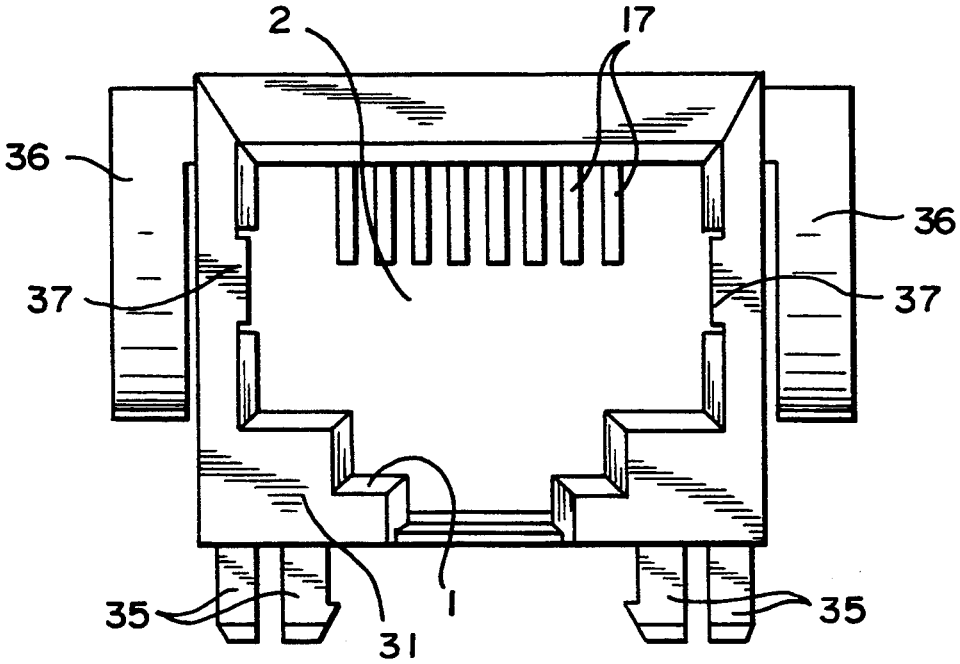
FIG. 5 is a front elevation of the modular jack of FIG. 1.

FIGS. 1–5 show a preferred modular jack connector which includes a molded one-piece plastic socket housing or body member 1 for receiving a plug (not shown) of conventional type. The socket is defined by a plug-receiving opening 2, a top surface 3 and a bottom surface 4 joined by opposed side surfaces 5 and 6 extending from the opening to a back surface 7. Housing 1 includes a plurality of horizontal contact grooves 8 in surface 3 for accommodating a plurality of electrical contacts 9 conventionally in the form of flat stamped metallic conductors, only one of which is shown. Guide grooves 8 converge towards the front of the socket so that the spacing at the front will match the spacing of contacts on a standard plug, which the rear is provided with a plurality of passages 10, larger in cross-sectional area than grooves 8 and arranged in two rows 11 and 12. The passages 10 extend vertically through the connector from top surface 3 to bottom surface 4. Furthermore, each of passages 10 in the respective rows communicates with each other via openings 10'', with portions 13 of alternate ones of the grooves 8 extending between rows 11 and 12. As is best shown in FIG. 2, a shelf 8' is formed forwardly of the top of passages 10 within grooves 8 to accommodate a notch 14 of the contacts, whose function will be described below. In addition, passages 10 narrow at their lower ends 10' so as to support and align contacts 9 when an electrical component is not present in the passage 10.

At the rear of opening 2 is a shelf 15 for supporting a distal end 16 of angled portions 17 of the contacts. Horizontal portions 18 of the contacts extend at an acute angle with respect to angled portions 17 and fit within grooves 8. Vertical portions 19 extending from the contacts through passages 10. The above-mentioned notches 14 are formed by angled portions 20 which form an obtuse angle with horizontal portions 18 and also with, in alternate contacts, respective horizontal notch portions 21 and 21'. Portions 21' are longer than portions 21 so that vertical portions 19 of alternate contacts can extend, via groove portions 13, through the back row 12 of passages 10 rather than through front row 11.

Housing 1 also includes grooves 22 from which extend shield latching projections 23. The shield case 31, which will be described in greater detail below, includes inwardly extending tines 33 which flex outwardly to clear projections 23 when the shield case is fitted over housing 1, and which engage a lower surface 23' of the projections to secure the shield case on the housing.

In the illustrated embodiment, the modular jack is arranged to include inductor elements in the form of monolithic ferrite blocks 24 shaped to fit within either row 11, row 12, or both rows 11 and 12 of passages 10, and having central bores 25 sized to accommodate vertical portions 19 of contacts 9. Ferrite blocks 24 include main inductor sections 26 through which bores 25 extend and connecting portions 27 which will fit within the openings by which the respective passages 10 communicate with each other. It will be appreciated that ferrite blocks 24 are removably assembled to the connector simply by inserting them into the corresponding rows 11 and/or 12, after which the contacts 9 are inserted into the appropriate bores 25 and also into grooves 18, with the distal ends 16 of the contacts bent to fit on shelf 15.

Figure 9:
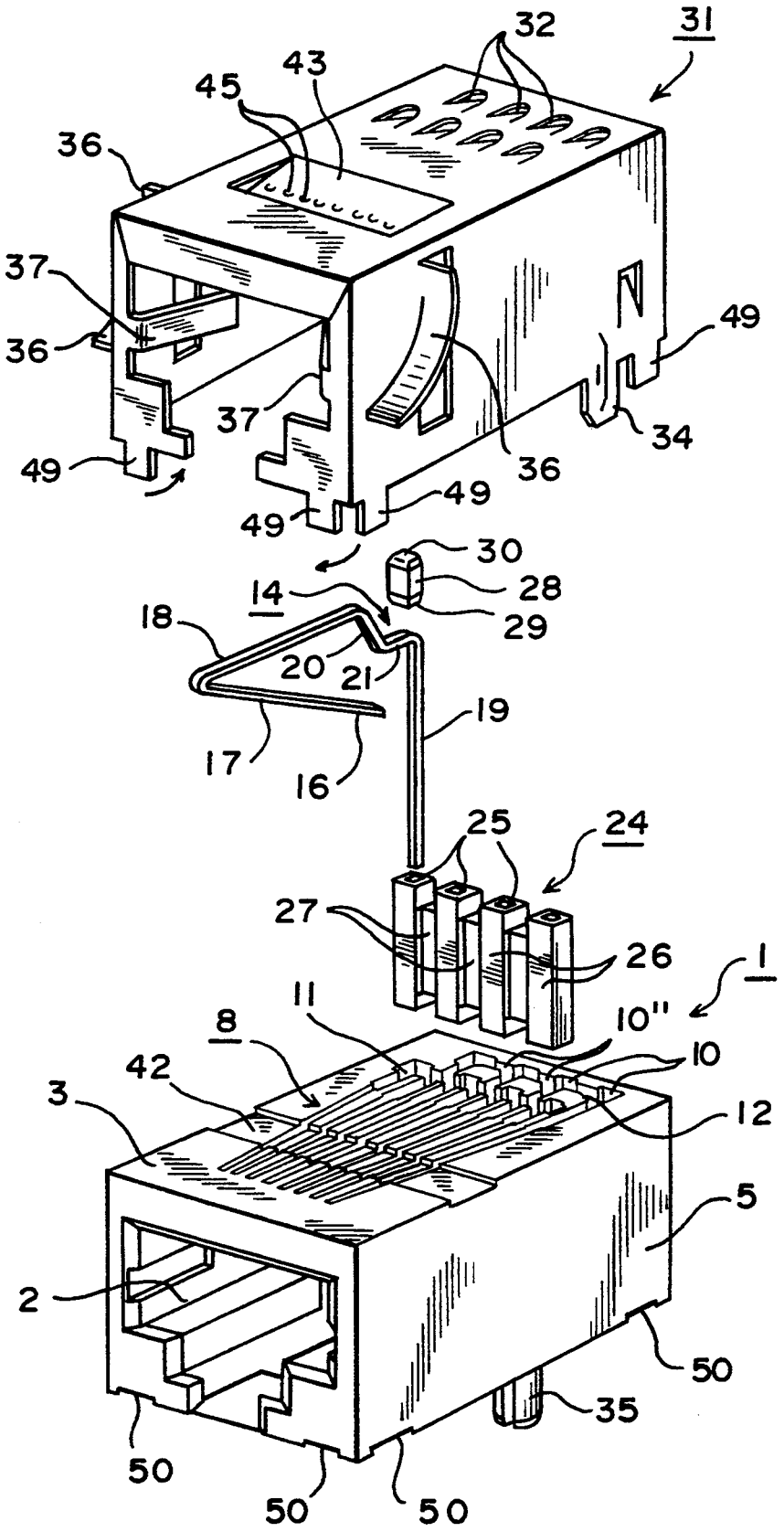
FIG. 9 is a perspective view corresponding to that of FIG. 1, but including the spark gap arrangement of FIGS. 7 and 8.

Notches 14 of the contacts 9 are designed to accommodate chip capacitors 28 each having a live electrode 29 and a ground electrode 30. These chip capacitors are removably fitted into passages 10 so that live electrodes 29 contact respective horizontal notch portions 21 of contacts 9. The chip capacitors 29 are grounded through electrodes 30 to a shield case 31 made up of a single stamped and formed sheet of conductive metal via integral inwardly extending tines 32, arranged in two rows corresponding to rows 11 and 12 of passages 10, when the shield case 31 is fitted over housing 1. As noted above, shield case 31 may include integral tines 33 which fit within grooves 32 of housing 1 as the shield case is being inserted over the housing, the tines flexing as they pass projections 23 in order to latch onto lower surfaces 23' and lock the shield case in place, or the shield may be even more securely locked onto the housing by tabs 49, as shown in FIG. 9 and described in more detail below. Shield case 31 further includes integral extensions 34 for mounting the shield case on a circuit board in cooperation with split posts 35 on socket 1, extensions 36 for grounding the case to a panel (not shown), and extensions 38 for grounding the shield case to a casing on a corresponding modular plug inserted into opening 2.

Preferably included in housing 1 is an arrangement for facilitating mounting of the contacts into the connector. This arrangement consists of molded-in projections 38 each having a ramp surface 39 which flexes as a contact 9 is inserted into grooves 8 and passages 10, the resilience of the conventional plastic material, from which the housing is preferably made, permitting the projection 38 to flex into the passage when the contact 9 is pushed past the projection, such that a top surface 40 on the contact engages a lower surface 41 of the projections to lock the contacts in place when the contacts are seated on the bottom surfaces of the grooves. Projections 38 extend downwardly and outwardly from side walls of grooves 8.

It will be apparent from the above description that assembly of the preferred connector requires at most only four principal steps. These steps are: (1) the insertion of the inductor block 24 into rows 11 and/or 12, (2) insertion of the contacts 9 into bores 25 in the inductor block 24 and into the guide grooves 8 until the contacts are locked into place by projections 38, (3) insertion of capacitors 28 into passages 10 to engage horizontal notch portions 21 of contacts 9, and (4) assembly of the shield case 31 onto housing 1 by fitting the shield case 31 over the housing and causing tines 33 to engage lower surfaces 23 of projections 23. Furthermore, steps 1 and 3 are both optional, permitting the assembler to select a variety of filter options for each contact or row of contacts, including both C and LC filters, with other combinations made possible by varying the type of filter and/or transient suppression elements inserted into the respective passages. In addition, selected contacts can also be left unfiltered simply by omitting steps 1 and 3.

Figure 8:
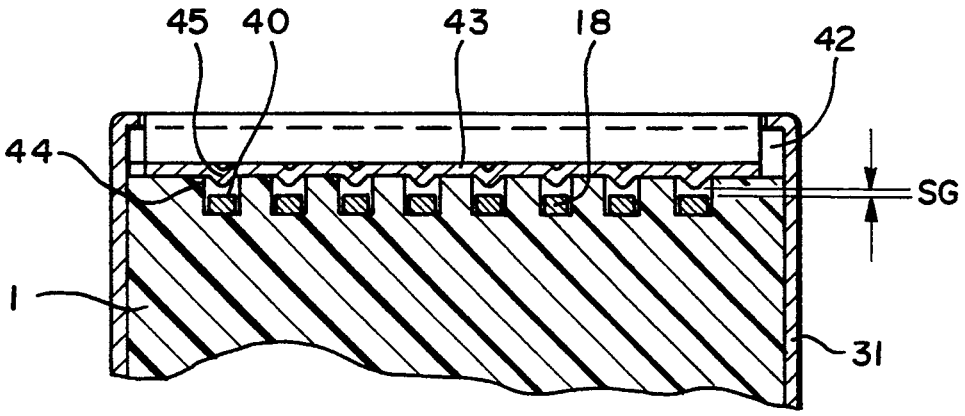
FIG. 8 is a cross-sectional front view of the spark-gap arrangement of FIG. 6.
Figure 7:
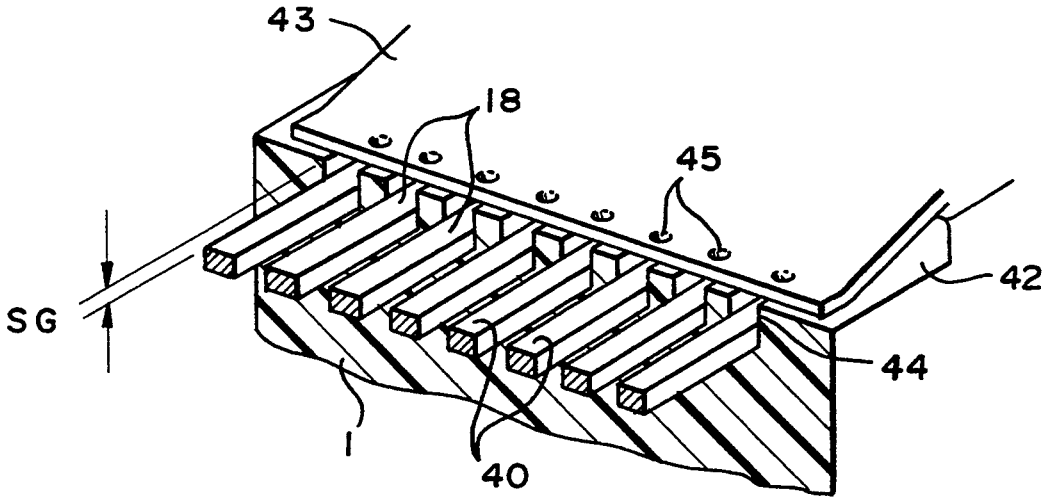
FIG. 7 is a cross-sectional perspective view showing spark gap arrangement for use with the modular jack of FIG. 1.

In a further advantageous embodiment of the invention, illustrated in FIGS. 7–9, the housing 1 and shield case 31 are modified by including, respectively, a cutout 42 in top surface 3 of housing 1 and an integral tab 43 on the metal shield. The cutout forms a plastic housing step 44; best shown in FIG. 8, having a height which is equal to the thickness of a contact plus a desired spark gap SG, less the thickness of dimples 45 provided in the tab. When the tab is fitted on the step, the dimples 45 extend into the groove such that the lowest portion of a dimple is a distance SG away from the top surface 40 of a contact to form the desired spark gap. Addition of the spark gap requires no additional assembly step, and can conveniently be implemented simply by stamping tab 43 and dimples 45 into the shield housing when the shield housing is manufactured, and varying the mold for housing 1 to include contact 43.

FIG. 9 also illustrates an alternative preferred arrangement for securing shield case 31 to housing 1. In this arrangement, instead of tines 33 and grooves 22, the shield case 31 and housing 1 are respectively provided with tabs 49 and slots 50. When shield case 31 is fitted over housing 1, tabs 49 are bent inwardly an angle 90° to engage the lower surface of the housing through slots 50 and thereby secure the shield case to the housing.

Having thus described specific embodiments of the invention in connection with FIGS. 1–9, it will be appreciated by those skilled in the art that numerous variations of the invention are possible. For example, the principles of the invention may extend to a variety of connectors other than the illustrated modular jack connector, and the construction of the housing, contacts and shield case may be varied according to the requirements of the connector in which it is used. These and other variations and modifications of the invention are all intended to be included within the scope of the invention, and consequently it is intended that the invention not be limited by the above description or illustrations, but rather that it be defined solely by the appended claims.

What is claimed is:

1. In a modular jack connector, comprising a housing having a plug-receiving opening, opposed top and bottom surfaces joined by opposed side surfaces extending from said opening to a back surface, and a plurality of elongated contacts mounted to the housing, each contact including a contact portion at one end extending diagonally into the opening, a vertical portion at a second end and an intermediate portion between said contact portion and vertical portion, and means defining a plurality of grooves in said top surface of said body for positioning said contacts, the improvement wherein:

at least one of said contacts includes a substantially vertical portion and a horizontal portion which together forms a notch in said contact, a chip capacitor seated in the notch, and wherein:

said connector further includes a shield having a top surface, opposed side surfaces extending from a front opening to join a back surface, and tines inwardly extending from said top surface to engage said capacitor.

2. A connector as claimed in claim 1, further comprising a cutout in said top surface of said housing, and a tab on said shield which extends into said cutout to engage a step formed by a lower surface of said cutout and walls of said grooves, said step serving to position said tab so as to define a spark gap between said tab and the contacts positioned in the grooves.

3. A connector as claimed in claim 2, wherein said tab includes downwardly extending dimples, a distance between distal ends of said dimples and the contacts equalling a length of said spark gap.

4. A connector as claimed in claim 1, further comprising inductor elements surrounding said contacts.

5. A shield for a modular jack, comprising:

a top surface joined by opposite side surfaces and a rear surface, tines inwardly extending from said top surface to engage electrical components in the modular jack, tines inwardly extending from said side surfaces to lock said shield on the modular jack, outwardly extending tabs for engaging a panel, and tabs extending into an opening in the modular jack for engaging a plug inserted into the modular jack, and further comprising a tab on said shield which extends into a cutout in said jack to engage a bottom surface of said cutout and thereby form a spark gap between the tab and contacts positioned in grooves in said bottom surface.

6. A shield as claimed in claim 5, wherein said tab on said shield which extends into the cutout includes downwardly extending dimples, a distance between distal ends of said dimples and the contacts equalling a length of said spark gap.

7. An electrical connector, comprising:

a body member;

at least one electrical contact positioned in said body member;

grounding means for grounding said contact through a first electrical component;

first positioning means for removably positioning said first electrical component in said body member such that first and second electrodes of the electrical component respectively engage the contact and the grounding means; and second positioning means for positioning in said body member an inductor electrically coupled with and surrounding said contact, wherein said first and second positioning means comprise communicating passages in said body member, and wherein said at least one contact is a plurality of contacts, and said inductors are in the form of a ferrite block having a plurality of bores through which said contacts are inserted, said ferrite block being positioned within at least one of said passages in said body member and including grooves arranged to engage projections in said one of said passages to position the ferrite block therein.

8. A connector as claimed in claim 7, wherein said grounding means comprises a shield, said shield comprising means including inwardly extending tines for engaging projections on said body member to latch said shield on said body member.

9. A connector as claimed in claim 7, wherein said grounding means comprises a shield, said shield comprising means including tabs extending from side walls of said shield which are bent to engage a lower surface of said body member and thereby latch said shield to said body member.

10. A connector as claimed in claim 7, wherein said body member comprises a plurality of substantially parallel grooves in a top surface thereof, said grooves having a bottom surface on which said contact is seated and side walls, said side walls including projections, said projections each having a ramp surface sloping downwardly and outwardly from walls of said grooves and a bottom horizontal surface which engages a top surface of the contact when the contact is seated on a lower surface of a respective groove to thereby retain the contact in the respective groove.

11. A connector as claimed in claim 7, wherein said first electrical component is a chip capacitor, thereby forming together with said inductor an LC filter for said contact.

12. A connector as claimed in claim 11, wherein said contact includes a vertical portion inserted into said ferrite block, a first horizontal portion extending transversely to said vertical portion, a second horizontal portion connected to said first horizontal portion by an angled portion which forms an angle of at least 90° with respect to both said horizontal portions, said first horizontal portion and angled portion forming a notch in said contact, said chip capacitor being seated within said notch.

13. A connector as claimed in claim 12, wherein said grounding means comprises a shield mounted on said body member, said shield including integral inwardly extending tines for engaging said second electrode of said first electrical component.

14. A connector as claimed in claim 13, wherein said shield further comprising means including second inwardly extending tines for engaging projections on said body member to latch said shield on said body member.

15. A connector as claimed in claim 13, wherein said shield further comprises means including tabs extending from side walls of said shield which are bent to engage a lower surface of said body member and thereby latch said shield to said body member.

* * * * *